US012601554B2

(12) United States Patent
Wagner et al.

(10) Patent No.: US 12,601,554 B2
(45) Date of Patent: Apr. 14, 2026

(54) FIREARM LOADER

(71) Applicant: Ralstec Corporation, Mukwonago, WI (US)

(72) Inventors: Leslie A. Wagner, Mukwonago, WI (US); Susan A. Arndt, Saint Paul, MN (US); Robert D Rohr, Laotto, IN (US); Robert H Meier, DeKalb, IL (US)

(73) Assignee: Ralstec Corporation

( * ) Notice: Subject to any disclaimer, the term of this patent is extended or adjusted under 35 U.S.C. 154(b) by 0 days.

(21) Appl. No.: 18/602,148

(22) Filed: Mar. 12, 2024

(65) Prior Publication Data

US 2025/0290717 A1 Sep. 18, 2025

(51) Int. Cl.
*F41A 9/83* (2006.01)

(52) U.S. Cl.
CPC ..... *F41A 9/83* (2013.01)

(58) Field of Classification Search
CPC ..... F41A 9/83
See application file for complete search history.

(56) References Cited

U.S. PATENT DOCUMENTS

| | | | | |
|---|---|---|---|---|
| 910,397 | A * | 1/1909 | Laudensack | F41A 9/83 42/87 |
| 4,509,284 | A | 4/1985 | Naber | |
| 4,756,110 | A | 7/1988 | Beltron | |
| 4,862,621 | A | 9/1989 | Kearney | |
| 7,866,080 | B2 | 1/2011 | Tucker | |
| 8,122,635 | B2 | 2/2012 | Pullicar et al. | |
| 8,353,123 | B2 | 1/2013 | Pullicar et al. | |
| 9,212,859 | B1 | 12/2015 | Tal et al. | |
| 10,345,065 | B2 | 7/2019 | Roe | |
| 11,274,891 | B2 * | 3/2022 | Stephens | F41A 9/72 |
| 2010/0313460 | A1 * | 12/2010 | Tucker | F41A 9/83 42/87 |

* cited by examiner

*Primary Examiner* — J. Woodrow Eldred

(57) ABSTRACT

A firearm loader includes a body defining a cavity with a first open end and a slot communicating with the cavity and an interface arm extending from the body. A method includes positioning a firearm loader on a firearm, the firearm loader comprising a body defining a cavity with a first open end and a slot communicating with the cavity and an interface arm extending from the body and transferring cartridges positioned in the cavity through a magazine opening of the firearm by engaging the cartridges through the slot and pushing the cartridges through the first open end. Positioning the firearm loader on the firearm comprises positioning the interface arm on a trigger guard of the firearm to align the first open end with the magazine opening.

22 Claims, 6 Drawing Sheets

FIREARM LOADER

BACKGROUND

The present disclosure relates generally to a loader for a firearm, such as a loader having body for holding ammunition to be loaded into the firearm and a handle extending from the body to engage the trigger guard of the firearm to position the loader and allow rapid loading of the ammunition.

BRIEF DESCRIPTION OF THE DRAWINGS

The present disclosure may be better understood, and its numerous features and advantages made apparent to those skilled in the art, by referencing the accompanying drawings. The use of the same reference symbols in different drawings indicates similar or identical items.

DETAILED DESCRIPTION

Figure 1A:
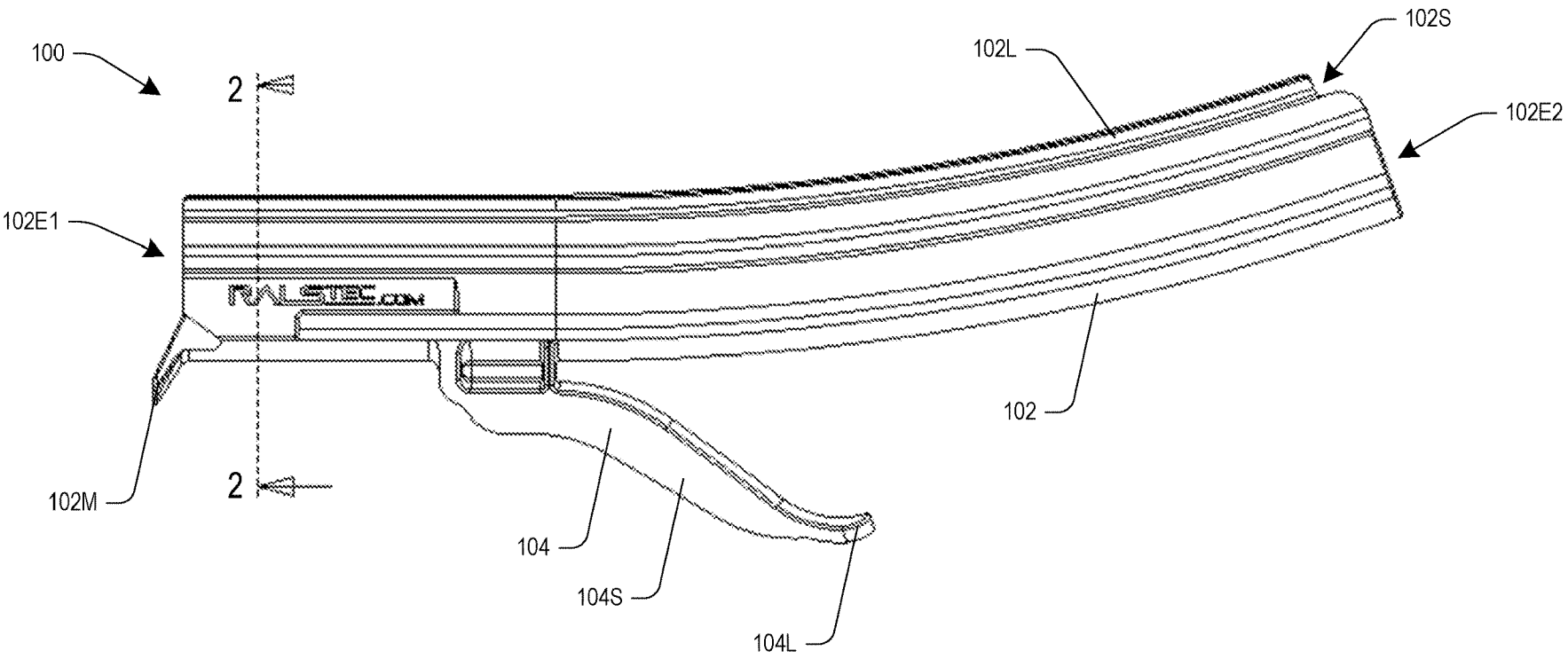
FIG. 1A is a side view of a firearm loader, in accordance with some embodiments.
Figure 1B:
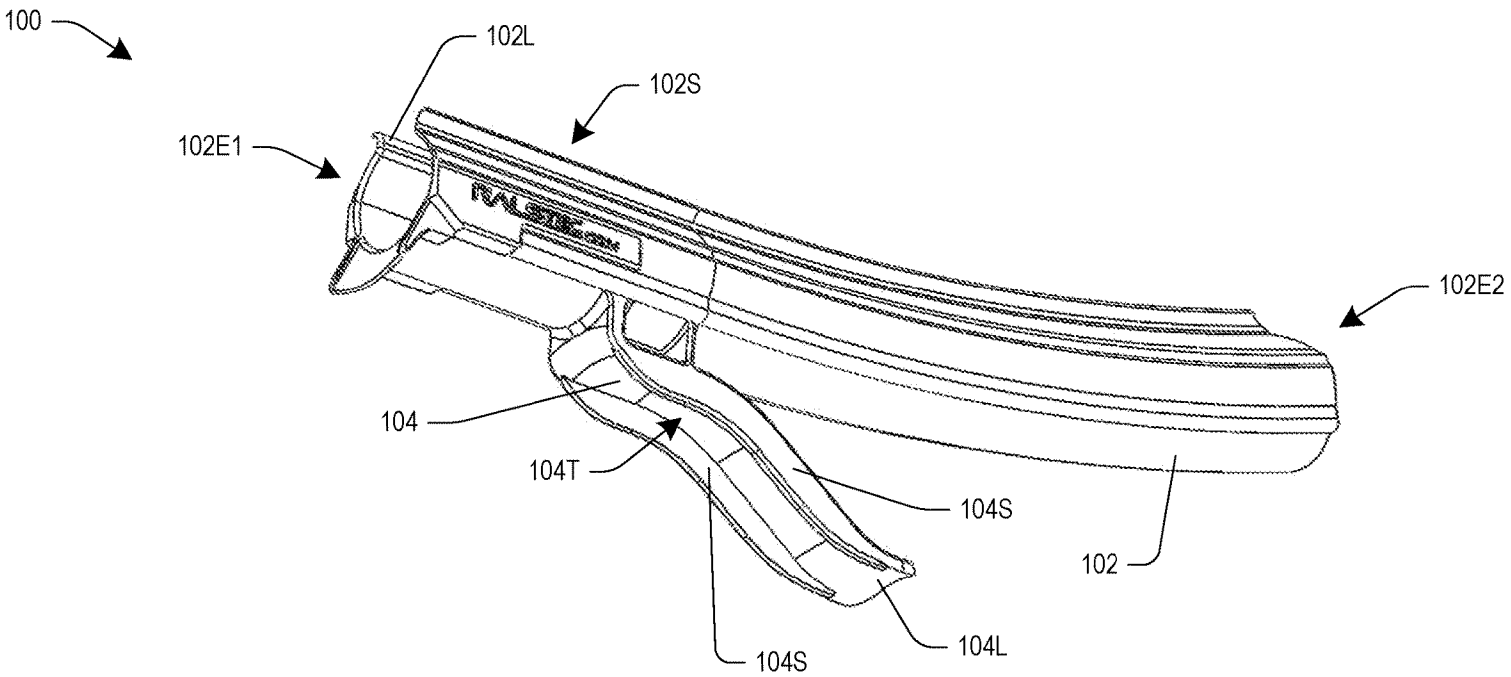
FIG. 1B is a bottom isometric view of the firearm loader, in accordance with some embodiments.
Figure 2B:
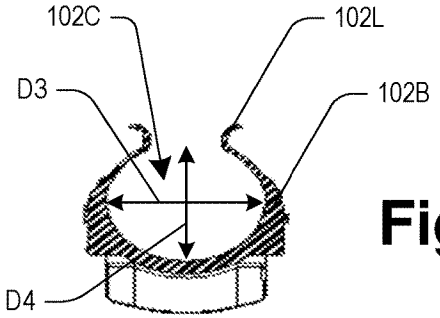
FIGS. 2A and 2B are cross section views of a body of the firearm loader, in accordance with some embodiments.
Figure 2A:
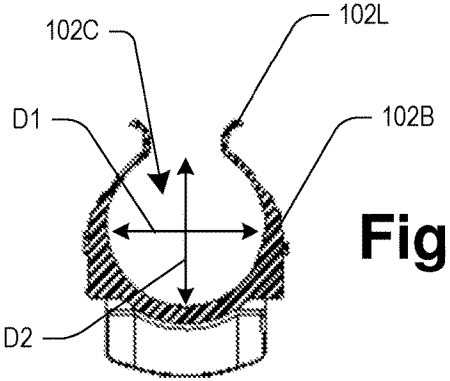
Figure 3B:
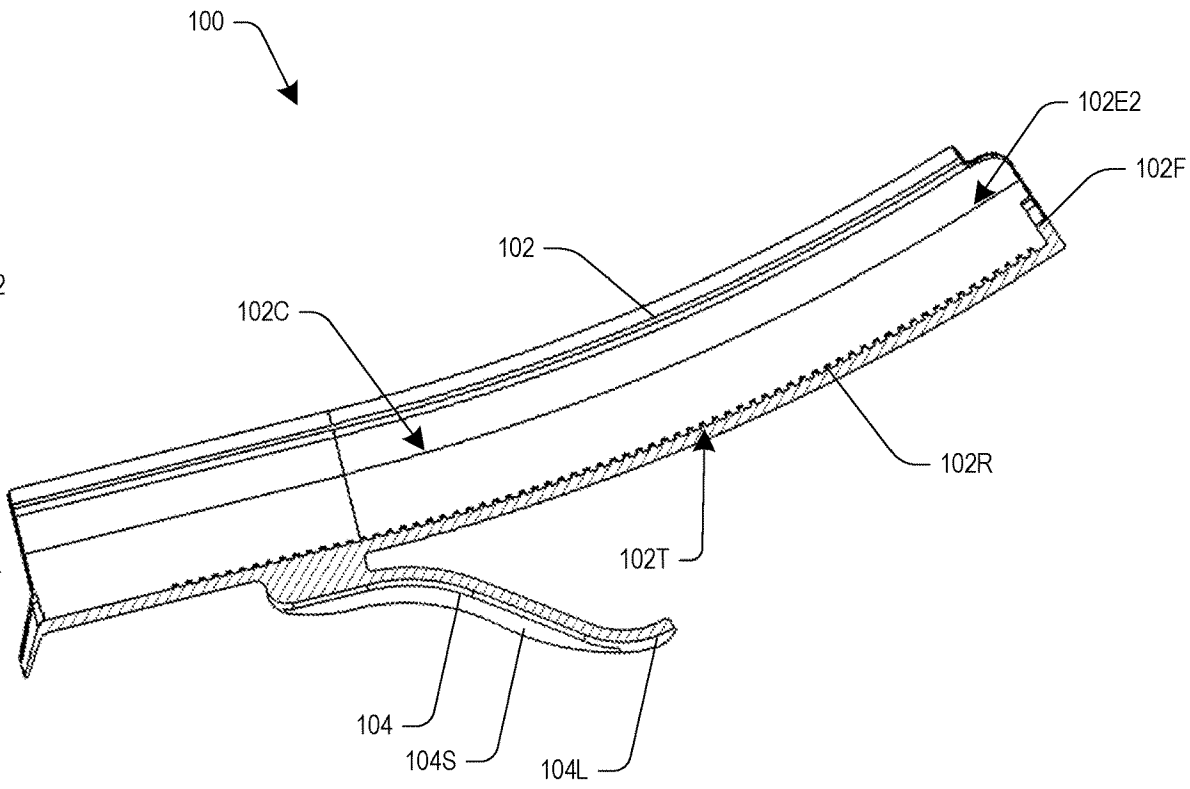
FIGS. 3A and 3B are end and side cross section views of the firearm loader illustrating a cartridge engagement track, in accordance with some embodiments.
Figure 3A:
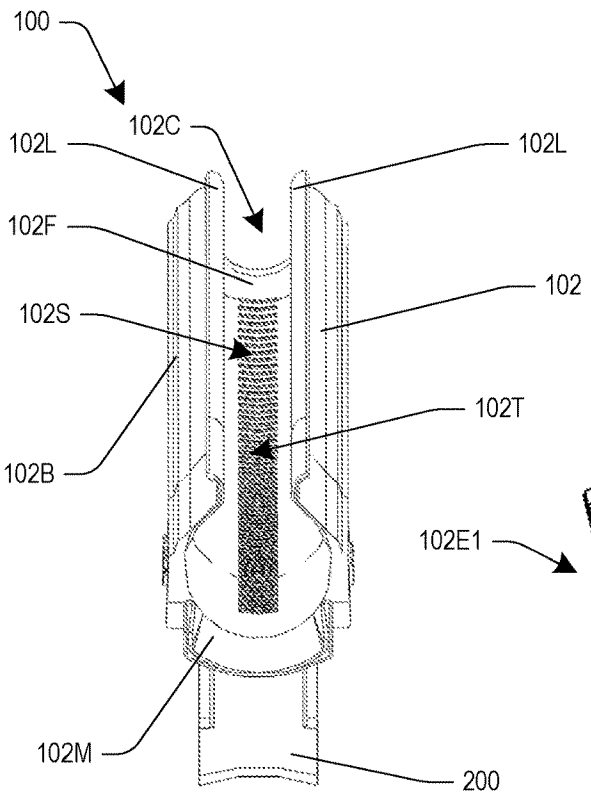
Figures 4, 5:
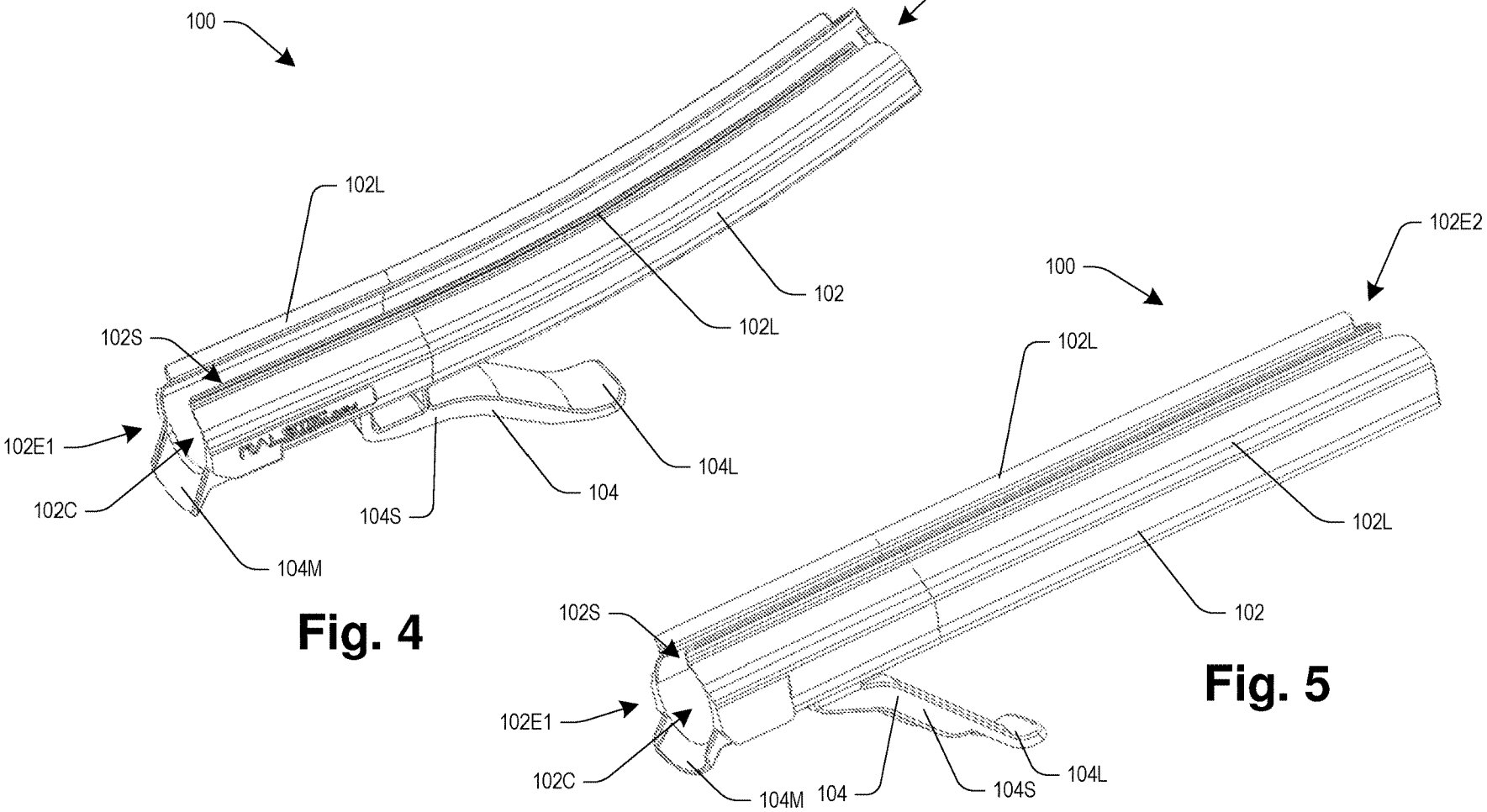
FIG. 4 is an isometric view of a firearm loader with body having an arcuate longitudinal shape, in accordance with some embodiments.
FIG. 5 is an isometric view of a firearm loader with a body having a linear longitudinal shape, in accordance with some embodiments.
Figure 6:
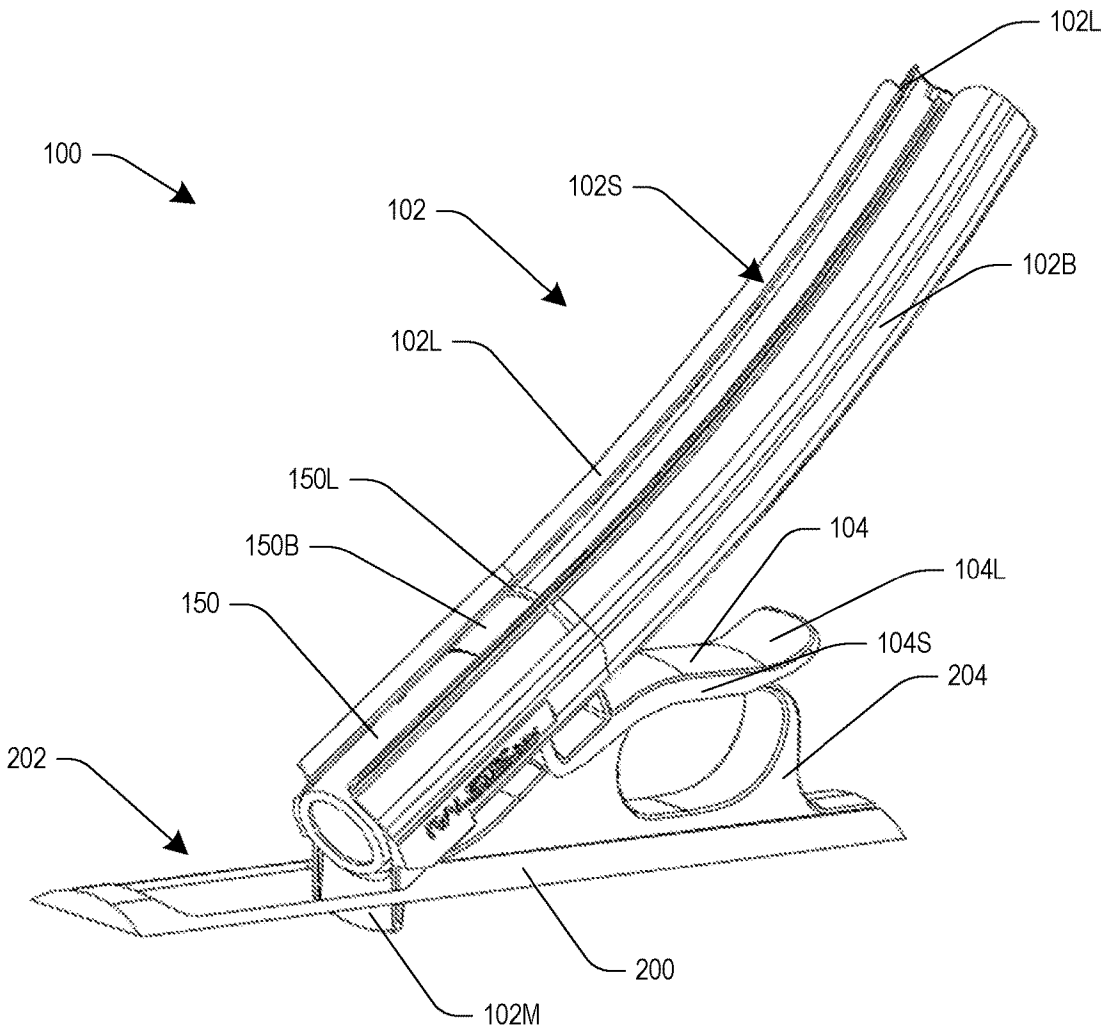
FIG. 6 is an isometric view of the firearm loader interfacing with a firearm, in accordance with some embodiments.
Figure 7:
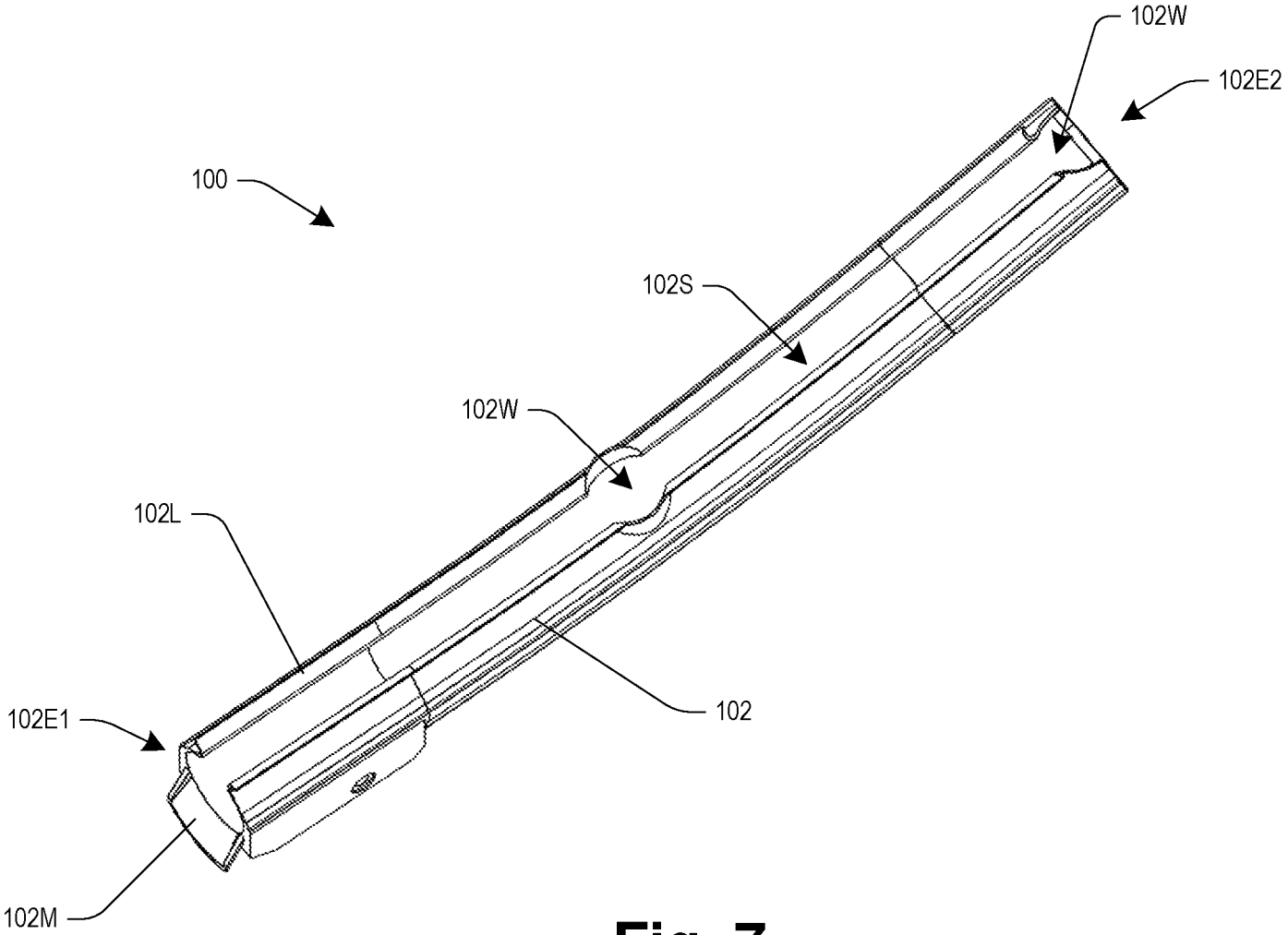
FIG. 7 is a view of an embodiment of a firearm loader with an intermediate finger window in the slot of the firearm loader, in accordance with some embodiments.

FIGS. 1A, 1B, 2A, 2B, 3A, 3B, and 4-7 illustrate example embodiments of a firearm loader 100, in accordance with some embodiments. FIG. 1A is a side view of the firearm loader 100. FIG. 1B is an isometric bottom view of the firearm loader 100. FIGS. 2A and 2B are end cross section views of a body 102 of the firearm loader 100, in accordance with some embodiments. FIGS. 3A and 3B are end and side cross section views of the firearm loader 100, respectively, illustrating a cartridge engagement track 102T, in accordance with some embodiments. FIG. 4 is an isometric view of the firearm loader 100 with an arcuate body, in accordance with some embodiments. FIG. 5 is an isometric view of the firearm loader with a body 102 having a linear longitudinal shape, in accordance with some embodiments. FIG. 6 is an isometric view of the firearm loader 100 interfacing with a firearm 200, in accordance with some embodiments. FIG. 7 is a view of an embodiment with an intermediate finger window in the slot of the firearm loader, in accordance with some embodiments.

In some embodiments, the firearm loader 100 comprises a body 102 and an interface arm 104 extending from the body 102. The body 102 has open ends 102E1, 102E2 to facilitate the positioning of cartridges 150 (e.g., shells or some other form of ammunition) in a cavity 102C defined by the body 102. The number of cartridges 150 that may be positioned in the cavity 102C depends on the length of the body 102 and the length of the cartridges. The body 102 may be sized to allow the number of cartridges 150 corresponding to a full load of the firearm 200. The body 102 may comprise a flexible material, such as plastic, that allows deflection of the body 102 to facilitate the positioning of the cartridges 150 in the cavity 102C and to provide a spring force arising from the deflection to retain the cartridges 150 in a cavity 102C. The diameter of the body 102 may be slightly less than the diameter of the cartridges 150 to increase the spring force retaining the cartridges 150.

A slot 102S is defined in the body 102 communicating with the cavity 102C to allow a user to position a finger through the slot 102S and into the cavity 102C to rapidly transfer the cartridges 150 to the firearm 200. In some embodiments, the body 102 includes outwardly turned lips 102L on the edges of the slot 102S to allow the user's finger to slide through the slot 102S without interference. The body also has a magazine lip 102M extending from the open end 102E1 that interfaces with a magazine opening 202 of the firearm 200. The magazine lip 102M and the interface arm 104 are positioned according to the lateral offset between the magazine opening 202 and the trigger guard 204. Different orientations may be provided for different firearms 200.

In some embodiments, the interface arm 104 is curved to match a shape of a trigger guard 204 of the firearm 200 and comprises an end lip 104L at an end of the interface arm 104 with a curvature opposite to that of the interface arm 104. In some embodiments, the end lip 104L may be straight (i.e. not curved) but extending in a direction different than the curvature of the interface arm 104. The end lip 104L serves as a place for a user to engage a finger to hold the firearm loader 100 in a position of engagement with the trigger guard 204. In some embodiments, the interface arm 104 comprises side lips 104S that define a track 104T into which the trigger guard 204 fits to prevent the firearm loader 100 from sliding laterally and disengaging the firearm 200. The magazine lip 102M and the interface arm 104 cooperate to orient the firearm loader 100 in a position to transfer the cartridges 150 to the magazine of the firearm 200.

FIGS. 2A and 2B are cross section views of the body 102 of the firearm loader 100 taken along the line 2-2 in FIG. 1A, in accordance with some embodiments. In the embodiment of FIG. 2A, the body 102 has a circular cross section where the diameter D1 in a first direction is equal to the diameter D2 in a second direction perpendicular to the first direction. In the embodiment of FIG. 2B, the body 102 has an oval cross section where a diameter D3 in a first direction is greater than a diameter D4 in a second direction perpendicular to the first direction. The oval cross section of FIG. 2B results in increased deflection of the body 102 when cartridges 150 are inserted into the cavity 102C, thereby increasing the spring force applied by the body 102 to the cartridges 150.

FIGS. 3A and 3B are end and side cross section views of the firearm loader 100 illustrating a cartridge engagement track 102T defined in the body 102, in accordance with some embodiments. The cartridge engagement track 102T includes ridges 102R defined in a surface of the body 102 in the cavity 102C that interface with a lip 150L in the primer base 150B of the cartridge 150 to hold the cartridge 150 in a longitudinal position along the length of the body 102 until the user pushes the cartridges 150 into the magazine of the firearm 200. The cartridge engagement track 102T along with spring force from deflection of the body reduces the likelihood that a cartridge 150 could fall of out of the open end 102E1 of the firearm loader 100 after being loaded into the cavity 102C.

In some embodiments, the body 102 comprises a flange 102F at the second open end 102E2. The flange extends into the cavity 102C at least partially around the radius of the body 102 at the second open end 102E2. The flange 102F reduces the likelihood that a cartridge 150 could fall of out of the open end 102E2 of the firearm loader 100 after being loaded into the cavity 102C.

FIG. 4 is an isometric view of a firearm loader 100 illustrating the arcuate longitudinal shape of the body 102, in accordance with some embodiments. FIG. 5 is an isometric view of a firearm loader 100 having a body 102 with a linear shape, in accordance with some embodiments. In FIG. 5, the interface arm 104 has a lesser degree of curvature than the interface arm 104 of the embodiment of the firearm loader 100 in FIG. 4. In some embodiments, the particular shape of the interface arm 104 may be adapted to the shape of the trigger guard 204 to increase the degree of engagement between the firearm loader 100 and the firearm 200. The shape and curvature of the arm 104 may depend on the of the position of the trigger guard 204 relative to the magazine opening 202 on the firearm 200.

FIG. 6 is an isometric view of the firearm loader 100 interfacing with a firearm 200, in accordance with some embodiments. For ease of illustration, only a portion of the firearm 200 is shown in FIG. 6. A cartridge 150 is positioned in the cavity 102C of the body 102. Additional cartridges 150 may be loaded into the cavity 102C. The cartridge 150 includes a primer base 150B with a lip 150L that interfaces with the cartridge engagement track 102T illustrated in FIGS. 3A and 3B to secure the cartridge 150 in the body 102 of the firearm loader 100. The magazine lip 102M is positioned in a magazine opening 202 of the firearm 200 and the interface arm 104 of the firearm loader 100 is positioned over a trigger guard 204 of the firearm 200. To transfer the cartridges 150 to the firearm 200, a user inserts a finger into the slot 102S and pushes the cartridges 150 along the body 102. The positional alignment provided by the magazine lip 102M and the interface arm 104 facilitates rapid transfer of the cartridges 150 to the firearm 200. The lips 102L on the slot 102S allow the user's finger to slide along the slot 102S without interference, also including the ease of cartridge 150 transfer.

FIG. 7 is a view of an embodiment of the firearm loader 100 with an intermediate finger window 102W in the slot 102S of the firearm loader 100, in accordance with some embodiments. The finger window 102W allows the transfer of a subset of the cartridges to the firearm 108. For example, the body 102 may be sized to hold four cartridges, and the finger window 102W may be provided at the midpoint of the slot 102S to allow two of the cartridges downstream of the window 102S to be transferred to the firearm 108 while leaving the other two cartridges upstream of the finger window 102F in the slot 102S. In some embodiments, a portion of a finger window 102W, such as half the window, may be provided at the end 102E2 of the body 102

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A firearm loader, comprising:

a body defining a cavity with a first open end and a slot communicating with the cavity;

outwardly turned lips defined in the body on edges of the slot; and an interface arm extending from the body.

2. The firearm loader of claim 1, comprising:

a magazine lip defined in the body and extending from the first open end.

3. The firearm loader of claim 1, comprising:

a lip extending from an end of the interface arm, wherein: the interface arm has a first curvature in a first direction; and the lip has a second curvature in a second direction opposite to the first direction.

4. The firearm loader of claim 1, comprising:

side lips extending from edges of the interface arm to define a track.

5. The firearm loader of claim 1, comprising:

a flange defined in the body and extending into the cavity at least partially around a second open end of the body.

6. The firearm loader of claim 1, comprising:

a cartridge engagement track comprising ridges defined in a surface of the body inside the cavity.

7. The firearm loader of claim 1, wherein:

the body defines a finger window in the slot having a width greater than a width of the slot.

8. The firearm loader of claim 1, wherein:

the body has an oval cross-section having a first diameter in a first direction greater than a second diameter in a second direction different than the first direction.

9. The firearm loader of claim 1, wherein:

the body has an arcuate longitudinal shape.

10. A method, comprising:

positioning a firearm loader on a firearm, the firearm loader comprising a body defining a cavity with a first open end and a slot communicating with the cavity, outwardly turned lips defined in the body on edges of the slot, and an interface arm extending from the body; and transferring cartridges positioned in the cavity through a magazine opening of the firearm by engaging the cartridges through the slot proximate the outwardly turn lips and pushing the cartridges through the first open end, wherein:

positioning the firearm loader on the firearm comprises positioning the interface arm on a trigger guard of the firearm to align the first open end with the magazine opening.

11. The method of claim 10 wherein:

the firearm loader comprises a magazine lip defined in the body and extending from the first open end; and positioning the firearm loader on the firearm comprises positioning the magazine lip in the magazine opening.

12. The method of claim 10 wherein:

the firearm loader comprises side lips extending from edges of the interface arm to define a track; and positioning the firearm loader on the firearm comprises positioning the trigger guard in the track.

13. The method of claim 10, wherein:

the firearm loader comprises a flange defined in the body and extending into the cavity at least partially around a second open end of the body; and the method comprises loading the cartridges through the slot such that one of the cartridges engages the flange.

14. The method of claim 10, wherein:

the firearm loader comprises cartridge engagement track comprising ridges defined in a surface of the body inside the cavity; and the method comprises loading the cartridges through the slot such that a lip on one of the cartridges engages the cartridge engagement track.

15. The method of claim 10, comprising:

deflecting the body to load the cartridges into the cavity through the slot, wherein:

the body exerts a spring force on the cartridges resulting from the deflection of the body.

16. The method of claim 10, wherein:

the body has an arcuate longitudinal shape; and transferring the cartridges comprises pushing the cartridges along the arcuate longitudinal shape.

17. An apparatus, comprising:

a firearm comprising:

a magazine opening; and a trigger guard having a lateral offset with respect to the magazine opening; and a firearm loader comprising:

a body defining a cavity with a first open end and a slot communicating with the cavity;

outwardly turned lips defined in the body on edges of the slot; and an interface arm extending from the body, wherein:

the arm has a shape corresponding to the trigger guard and extends from the body in a location corresponding to the lateral offset between the magazine opening and the trigger guard.

18. The apparatus of claim 17, wherein:

the firearm loader comprises a magazine lip extending from the first open end at a position corresponding to the lateral offset between the magazine opening and the trigger guard.

19. The method of claim 10, wherein:

the firearm loader comprises a lip extending from an end of the interface arm, wherein:

the interface arm has a first curvature in a first direction;

the lip has a second curvature in a second direction opposite to the first direction; and positioning the firearm loader on the firearm comprises engaging the lip to maintain engagement of the firearm loader with the trigger guard.

20. A firearm loader, comprising:

a body defining a cavity with a first open end and a slot communicating with the cavity;

a magazine lip defined in the body and extending from the first open end; and an interface arm extending from the body.

21. A firearm loader, comprising:

a body defining a cavity with a first open end and a slot communicating with the cavity;

an interface arm extending from the body; and a lip extending from an end of the interface arm, wherein:

the interface arm has a first curvature in a first direction; and the lip has a second curvature in a second direction opposite to the first direction.

22. A firearm loader, comprising:

a body defining a cavity with a first open end and a slot communicating with the cavity; and an interface arm extending from the body, wherein:

the body has an oval cross-section having a first diameter in a first direction greater than a second diameter in a second direction different than the first direction.

* * * * *